United States Patent [19]

Cargile, Jr.

[11] Patent Number: 5,056,709

[45] Date of Patent: Oct. 15, 1991

[54] MULTIPLE COMPARTMENT PAPERBOARD CARTON

[75] Inventor: John W. Cargile, Jr., Decatur, Ga.

[73] Assignee: Kliklok Corporation, Decatur, Ga.

[21] Appl. No.: 596,768

[22] Filed: Oct. 12, 1990

[51] Int. Cl.[5] ..... B65D 25/04

[52] U.S. Cl. ..... 229/120.17; 229/120.2

[58] Field of Search ..... 229/120.06, 120.08, 229/120.12, 120.17, 120.18, 120.23, 120.35

[56] References Cited

U.S. PATENT DOCUMENTS

| | | | |
|---|---|---|---|
| 2,046,485 | 7/1936 | Ringler . | |
| 2,710,133 | 6/1955 | Repkung et al. | 229/120.12 |
| 3,771,713 | 11/1973 | Davidson . | |
| 3,876,132 | 4/1975 | Kuchenbecker . | |
| 3,942,710 | 3/1976 | Collie | 229/120.12 |
| 4,304,352 | 12/1981 | Humphries . | |

FOREIGN PATENT DOCUMENTS

| | | | |
|---|---|---|---|
| 1057539 | 3/1954 | France | 229/120.12 |

*Primary Examiner*—Stephen Marcus
*Assistant Examiner*—Christopher J..McDonald
*Attorney, Agent, or Firm*—King and Schickli

[57] ABSTRACT

A paperboard carton of multiple compartments and leakproofness for packaging separate food items is provided. Adjacent side panels and bottom panels merge to form the corners. Diagonal divider panels extend from the corners to the opposite side panel and along the bottom panels. A pair of gusset panels are provided to reinforce the corners and to connect the side panels. Each gusset panel extends from a side panel and the adjacent divider panel. The gusset panels are overlapped and folded around the corner and sealed with thermoplastic adhesive against the adjacent side panel. The divider panel is doubled forming an inverted V. The two divider panels provide miror image triangular compartments and a trapezoidal central compartment. A cover hinged along the side panel of the central compartment between the reinforced corners is sealed to the carton along sealing flanges to close and complete the carton.

12 Claims, 1 Drawing Sheet

10
11
12
12a
12b
12c
13
14
15
16
17
18
19
20
21
21a
25
25a
26
30
31
32
33

MULTIPLE COMPARTMENT PAPERBOARD CARTON

BACKGROUND OF THE INVENTION

The present invention relates to a leakproof carton for packaging separate food items or the like, and more particularly to a carton having multiple compartments formed of a paperboard blank and particularly adapted for use with microwavable ready-to-eat meals.

In the past several years, there has been substantial research and development in the packaging field along the lines of leakproof cartons/trays particularly adapted for microwave use. The most popular type of these cartons is formed of paperboard coated with a thin plastic film, such as polyethylene. The cartons are preformed with fold lines and cut so as to be easily erected on automatic packaging machines. As thus formed, the cartons are not only relatively low cost and microwavable, but are also popular because they are relatively environmental friendly.

One of the most popular types of cartons in this field is exemplified by the invention set forth in U.S. Pat. No. 4,304,352, Flanged Tray With Gusset Corners, issued Dec. 8, 1981 and assigned to the present assignee. This carton is leakproof and easy to form with corners constructed of attached gusset panels. When erected, the gusset panels are overlapped and sealed against the adjacent side panel. The pair of gusset panels form the leakproof corner by being connected by a fold line to each other and fold lines to the adjacent side panels.

The inside gusset panel includes a cut-out portion allowing efficient sealing and attachment of the outer gusset panel against the side panel of the carton.

Other attempts have been made in the past to improve on this type of carton or tray. These efforts have been concentrated generally in the area of refinements in the coated paperboard, different gusset/panel arrangements, modified sealing flange arrangements and refined carton opening concepts.

In addition, in the past, there has been some attempt to provide successful multi-compartment cartons. In this regard, the efforts are focused in providing separate rectangular compartments separated by a divider panel. An example of this type of effort is illustrated in U.S. Pat. No. 3,876,132, entitled Multi-Compartment Tray and issued Aug. 8, 1975. Success with this type of carton has been limited due to several shortcomings. The carton is bulky, overweight and requires additional full depth, outside flaps along the side panels in order to provide sufficient strength. This feature also makes the carton blank overly expensive.

This prior art carton is also unsuited for small servings of food items and the like since to reduce the volume of the compartments results in compartments too narrow to fill and/or too restricted to conveniently remove the food item during eating, as is frequently desired when using this type of carton.

Accordingly, there is identified a need for an improved paperboard carton having multiple compartments and more adapted to holding a plurality of different food items in a leakproof fashion. The carton needs to be adapted for holding relatively small portions, such as single helpings so that the carton can be used as a ready-to-eat or TV tray type carton. Most importantly, the carton should be designed to be reinforced for stability and at the same time easy to erect on automatic machinery from a paperboard blank using minimum paperboard for economy.

SUMMARY OF THE INVENTION

Accordingly, it is a primary object of the present invention to provide a new and improved paperboard carton having multiple compartments and overcoming the shortcomings of the prior art.

It is another object of the present invention to provide a carton that is leakproof, ovenable and microwavable wherein separate compartments are provided and at least one of the compartments is triangular in shape.

It is another and related object of the present invention to provide a carton that is easily formed of a minimum paperboard blank on automatic machinery and fully reinforced for strength including at least one diagonal divider panel extending from a corner of the carton.

It is still another object of the present invention and related to the above objects to provide a multiple compartment carton wherein the divider extends from a corner to the opposite side panel and with gusset panels on the ends of the divider panel overlapping and sealed against the side panels for reinforcement and to provide leakproofness.

It is still another object of the present invention to provide a carton having diagonal divider panels forming at least two triangular compartments extending from two corners and a trapezoidal center compartment, each compartment being fully leakproof and preventing food or the like in adjacent compartments from mixing.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved paperboard carton having multiple compartments and being leakproof for packaging separate food items is provided. The adjacent side panels and bottom panels merge to form a corner of the carton with at least one diagonal divider panel extending from the corner. Connector means are provided for holding the side panels erect. The connector means are sealed against the adjacent side panel and to each other. The resulting carton includes a triangular compartment with a reinforced corner and providing an enlarged open area for filling and removing the food item. The overall carton structure is substantially reinforced by the triangular shape, which is inherently more rigid than the prior art rectangular shapes in similar cartons.

Preferably, the connector means at the corner includes a pair of folded gusset panels wherein each gusset panel extends from one of the side panels and also from the adjacent divider panel. The divider panel may be doubled forming an inverted V. The gusset panels are overlapped and folded around the corner providing the reinforced corner structure.

The outside overlapped gusset panel includes an extension tab and suitable adhesive means is provided between the tab and adjacent side panel. In the preferred embodiment, the adhesive means may be the thermoplastic coating, such as a polyethylene film, extruded onto the surface of the paperboard blank and forming the inside surface of the completed carton. The end of the divider panel opposite the corner includes a second connector means attached to the opposite side panel at an intermediate point to complete the formation of the compartment. The second connector means is preferably identical to the first connector means at the corner including the pair of gusset panels. The outside overlapped gusset panel in this instance also includes an extension tab sealed to the side panel and forming a planar portion of said panel.

In the instance where three separate compartments are desired in the carton, a second divider panel is provided forming a substantially mirror image compartment extending from another corner. Between the two triangular compartments is a central trapezoidal shaped compartment. Thus, the opposite side panel is formed in three segments connected by the second connector means.

Advantageously, the side panel between the two corners includes a cover hinged along an uninterrupted fold line. The cover mates with the entire open area of the carton and is sealed along flanges provided between the cover and the side panels.

As a result of this improved structure with the gusset panels forming a part of the divider panels and extending into the corners of the carton, there is greatly enhanced strength, while at the same time improving the economy of the paperboard use. Because each compartment is isolated by folded gusset panels that are in turn overlapped and sealed against a side panel, complete separation of the food items and leakproofness of the carton is assured. The triangular geometry uniquely strengthens the body of the carton adding to the stiffness to provide for easy handling, both by the food processor and the ultimate customer. The full carton can be easily handled, even by one hand gripping at a corner due to the reinforcing and stiffening features primarily provided by the diagonal divider panel.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention, and together with the description serves to explain the principles of the present invention. In the drawings.

Figures 1, 2, 3, 4, 5, 6:
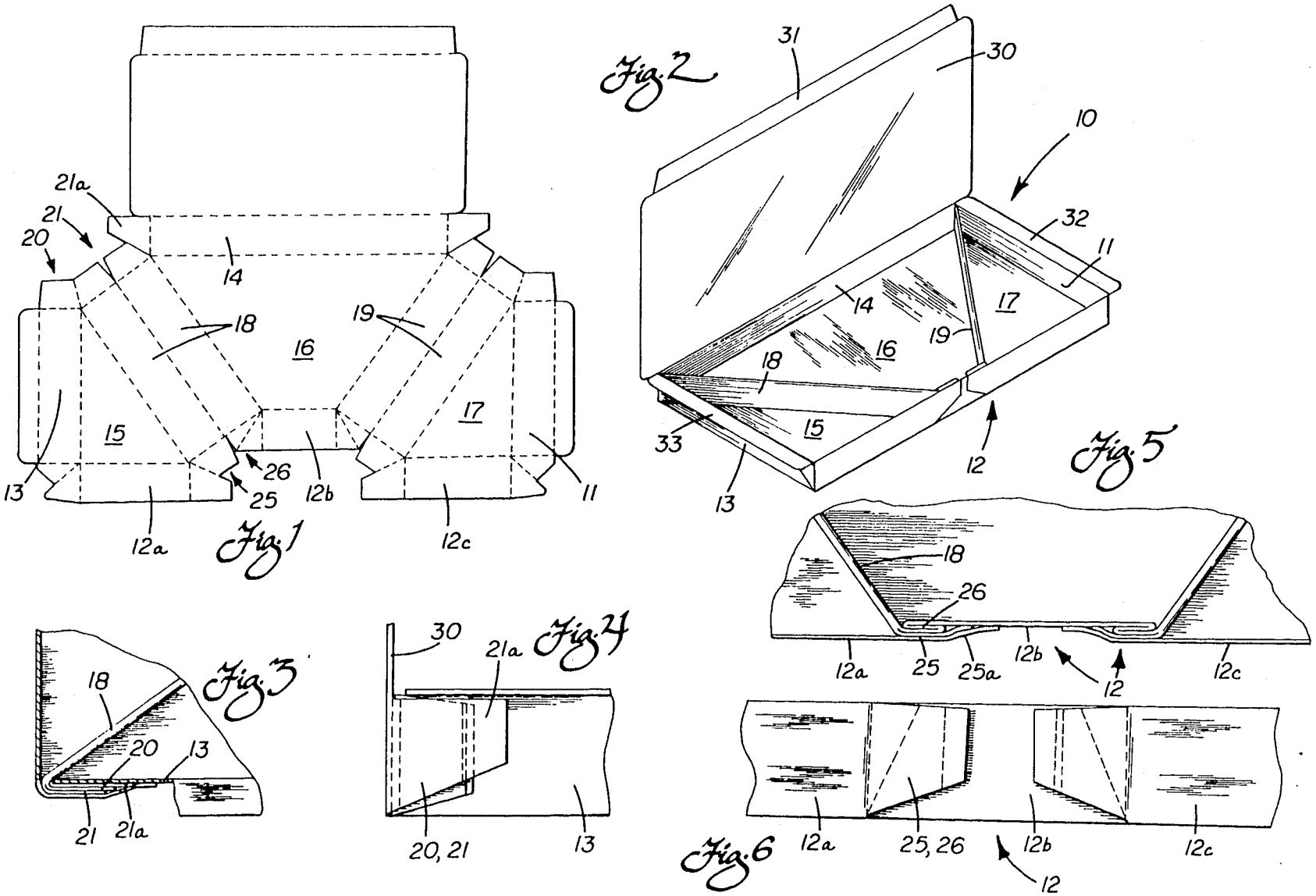
FIG. 1 is an overall plan view of the paperboard blank for forming the carton of the present invention.
FIG. 2 is a perspective view of the erected carton.
FIG. 3 is an enlarged cut-away top view showing the reinforced corner structure of the carton.
FIG. 4 is an enlarged cut-away side view of the corner structure of FIG. 3.
FIG. 5 is an enlarged cut-away top view of the multi-segment side panel structure that includes the gusset panels of the diagonal divider panel.
FIG. 6 is an enlarged cut-away side view of the side panel of FIG. 5.

Reference will now be made in detail to the present preferred embodiment of the invention, an example of which is illustrated in the accompanying drawing.

DETAILED DESCRIPTION OF THE INVENTION

Reference is now made to FIGS. 1 and 2 showing an improved multiple compartment leakproof carton 10 constructed in accordance with the principles of the present invention. The showing in FIG. 1 specifically provides the layout of the paperboard blank prior to being erected into the finished carton 10 of FIG. 2. The machine and method for erecting the carton does not form a part of the present invention, but suffice it to say that the manner in which the blank is pre-creased, folded and cut, as shown, lends itself well to automatic forming. Generally, the carton is erected by operation of a plunger pushing the blank through a die, and simultaneously pressing the crucial preheated seal areas together.

As will be evident from viewing FIG. 2, the preferred embodiment of the carton 10, which is generally in the form of an open tray with a cover, comprises four interconnected side panels 11–14 and three interconnected bottom panels 15–17 (see FIG. 2). The position of these panels in the unfolded blank can be seen in FIG. 1. Positioned in between the bottom panels 15–17 are two divider panels 18, 19.

In accordance with an important aspect of the present invention, the divider panels 18, 19 extend diagonally across the carton 10 (note in particular FIG. 2). The divider panels 18, 19 extend from the two corners between side panels 13, 14 and 11, 14 toward the opposite side panel 12. With this arrangement, it is readily apparent that two triangular compartments with bottom panels 15, 17 are formed along with a central trapezoidal shaped compartment defined by the bottom panel 16. The two side compartments are particularly adapted for single servings of a vegetable, fruit or dessert while the central compartment is sized and adapted for a main course or entree, in the instance where the carton 10 is used for packaging of an individual meal.

During formation of the carton 10, the two parts or components of the divider panels 19 are gathered while each of the side panels 11–14 are pushed upwardly to the vertical position in the forming machine. The divider panels 18, 19 in their vertical position form an inverted V and are thus attached along fold lines to respective bottom panels 15, 16 and 16, 17 respectively.

Advantageously, the side panels 11–14 and the diagonal divider panels 18, 19 are connected and held erected by a pair of gusset panels, generally designated by the reference numerals 20, 21 (see FIG. 1). Specifically, a first gusset panel 20 extends along a fold line from the adjacent side panel 13 and a fold line from one side of the divider panel 18. In a similar manner, the gusset panel 21 extends from the side panel 14 and the divider panel 18.

As can now be apparent, the adjacent side panels 13, 14 with the pair of gusset panels 20, 21 form the corner structure of the carton 10; it being understood that the corner structure formed between the side panels 11 and 14 and the divider panel 19 is identical and need not be specifically described.

The opposite end of the diagonal divider panels 18, 19 are connected to form a multiple segmented sidewall, generally designated by reference numeral 12. In a like fashion with the pair of gusset panels 20, 21, just described, gusset panels 25, 26 provide connection and reinforcement of the carton 10.

It should be noted that the central fold line of each of the gusset panels 20, 21, 25, 26 assures that each compartment is leakproof and isolated from the others. It is a unique feature that each of the gusset panels 20, 21, 25, 26 are attached and overlapping one side panel 11, 13 or 14.

The manner of folding the pair of gusset panels 20, 21 and 25, 26 can best be seen in FIGS. 3–6 of the drawings. Beginning with the corner formed between adjacent side panels 13, 14, bottom panels 15, 16 and the divider panel 18, reference is made to FIG. 3. The gusset panel 20 is folded along its common fold line, and then folded and overlapped so as to be brought into engagement with the side panel 13. The gusset panel 21 is likewise folded along the common fold line and then in overlapping relationship with the gusset panel 20. The outside section of the gusset panel 21 includes an extension tab 21*a* (see FIG. 4) that is pre-heated to activate the thermoplastic coating and thus form the adhesive bond when pressed against the side panel 13. Preferably, the upper surface of each of the gusset panels 20 and 21 are also pre-heated to assist in the connecting and holding function of the corner structure.

The end of the diagonal divider panel 18 opposite the corner just described is connected at an intermediate point along the side panel 12, including panel segments 12*a*, 12*b* and 12*c*. As shown in FIG. 5, the gusset panels 25, 26 are overlapped and turned outwardly against the center panel segment 12*b* and heat sealed against the outside surface. The outermost gusset panel 25 connected to side panel segment 12*a* includes an extension tab 25*a* for sealing directly against the center segment 12*b*.

The second divider panel 19 forms a substantially mirror image triangular compartment that includes the bottom panel 17. The corner structure, as well as the attachment to the side panel 12, is identical, as previously indicated.

The side panel 14 extends uninterrupted along substantially the full length of the carton 10. A cover 30 is hinged along a fold line along the length of side panel 14 (see FIG. 2 and 4). Along the edge of the cover is a sealing flange 31 adapted to overlap the side panel 12 when the carton is closed. Side sealing flanges 32, 33 along the side panels 11, 13, respectively may be provided to seal to the other two edges of the cover 30.

In summary, an improved multiple compartment carton 10 that is leakproof and requires a minimum of paperboard is provided. The pair of gusset panels 20, 21 are folded, overlapped and sealed around the corner on each other to form an integral part of the corner of the carton and provide substantial reinforcement in this area (see FIG. 3). Similarly, the pair of gusset panels 25, 26 are folded in overlapping fashion and attached to the multi-segmented side panel 12 (see FIG. 5).

The carton 10 is fully leakproof because of the unique manner in which the gusset panels 20, 21, 25, and 26 are formed between the divider panels 18, 19 and the side panels 13, 14. The gusset panels 20, 21 and 25, 26 are connected to both a side panel and a divider panel to assure this function. The triangular shape of the compartments provided by the divider panels 18, 19 extending from the corners substantially enhances the carton's structural strength.

The combination of the two triangular compartments with bottom panels 15, 17 and the trapezoidal shaped central compartment with bottom 16 makes an ideal carton for single serving food service. The enlarged open area afforded by these compartments provides easier filing, as well as easier removal of the food contents for serving.

The foregoing description of a preferred embodiment of the invention is presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of the ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A multiple compartment leakproof carton formed from a paperboard blank for packaging separate food items or the like comprising;
   - adjacent side panels and bottom panels merging to form corners of said carton;
   - at least one diagonal divider panel extending from at least one corner and between said side panels and along said bottom panels;
   - connector means for said side panels and said divider panel at said corner; and
   - means for sealing said connector means to the adjacent side panel and to each other;
   - whereby a triangular compartment with a reinforced corner and enlarged open area is formed in said carton.

2. The leakproof carton of claim 1 wherein said connector means includes a pair of folded gusset panels, one gusset panel extending from each side panel and the adjacent divider panel.

3. The leakproof carton of claim 2 wherein said divider panel is doubled forming an inverted V.

4. The leakproof carton of claim 2 wherein the pair of gusset panels are folded around the corner in overlapping relationship.

5. The leakproof carton of claim 4 wherein the outside overlapped gusset panel includes an extension tab, said sealing means including adhesive means between said tab and the adjacent side panel.

6. The leakproof carton of claim 1 wherein the end of said divider panel opposite said corner is connected by second connector means at an intermediate point along the opposite side panel to form the compartment.

7. The leakproof carton of claim 6 wherein said second connector means includes a pair of folded gusset panels, one gusset panel extending from each side panel and the adjacent divider panel.

8. The leakproof carton of claim 7 wherein the pair of gusset panels are folded in overlapping relationship, the outside overlapped gusset panel includes an extension tab, said sealing means including adhesive between said tab and the adjacent side panel, said second connector means forming a planar portion of said opposite side panel.

9. The leakproof carton of claim 7 wherein is provided a second divider panel forming a substantially mirror image triangular compartment in said carton.

10. The leakproof carton of claim 9 wherein is formed a central trapezoidal compartment between said triangular compartments, said opposite side panel being formed in three segments connected by said second connector means.

11. The leakproof carton of claim 10 wherein the side panel between said corners is uninterrupted extending substantially the full length of said carton and cover means for said carton attached along a fold line of said side panel.

12. The leakproof carton of claim 11 wherein is provided sealing flanges between said cover and said side panels.

* * * * *